United States Patent [19]

Liljendahl

[11] Patent Number: 4,502,522

[45] Date of Patent: Mar. 5, 1985

[54] HEAT-INSULATING ROLLER-BLIND

[76] Inventor: Sven A. J. Liljendahl, Gyllenstiernas vag 8, D-175 76 Jarfalla, Sweden

[21] Appl. No.: 413,372

[22] PCT Filed: Dec. 8, 1981

[86] PCT No.: PCT/SE81/00364

§ 371 Date: Aug. 9, 1982

§ 102(e) Date: Aug. 9, 1982

[87] PCT Pub. No.: WO82/02070

PCT Pub. Date: Jun. 24, 1982

[30] Foreign Application Priority Data

Dec. 8, 1980 [SE] Sweden ..... 8008599

[51] Int. Cl.[3] ..... E06B 9/08

[52] U.S. Cl. ..... 160/121 R

[58] Field of Search ..... 160/DIG. 7, 12, 290 R, 160/121, 238; 52/2, 202, 81; 49/477; 46/90

[56] References Cited

U.S. PATENT DOCUMENTS

| | | | |
|---|---|---|---|
| 1,736,075 | 11/1929 | Galley | 160/DIG. 12 |
| 2,774,421 | 12/1956 | Lion | 160/238 |
| 2,874,612 | 2/1959 | Luboshez | 160/238 |
| 3,009,498 | 11/1961 | Fohr | 46/90 |
| 3,113,551 | 12/1963 | Korn | 46/90 X |
| 4,039,019 | 8/1977 | Hopper | 160/121 R |
| 4,344,473 | 8/1982 | Shore | 160/121 R |

FOREIGN PATENT DOCUMENTS

| | | | |
|---|---|---|---|
| 2447450 | 9/1980 | France | 160/272 |

*Primary Examiner*—Peter M. Caun
*Assistant Examiner*—Cherney S. Lieberman
*Attorney, Agent, or Firm*—McGlew and Tuttle

[57] ABSTRACT

A heat insulating roller blind is made of two congruent sheets which are joined at their side and bottom edges by a soft elastic band. Valve means allow room air into the space between the sheets and permit the outflow of the air when the blind is rolled up. Tab means are connected to one of the sheets to add in separating them when the blind is unrolled.

23 Claims, 5 Drawing Figures

HEAT-INSULATING ROLLER-BLIND

FIELD AND BACKGROUND OF THE INVENTION

The present invention concerns a heat-insulating roller-blind intended to be placed in front of a window.

Since the realization that the energy supplies are limited and that the cost of energy has risen considerably, it has become important to save on heating energy. New building standards have been developed for the purpose of increasing the heat-insulating capacity of new houses and measures have been accepted for additional insulation of previously built houses. According to the new constructon standards the window surface area is limited to a certain percentage of the facade surface. Furthermore, triple glazed windows are prescribed in order to increase the heat-insulating capacity of the windows and thus to further decrease heat loss through the window.

SUMMARY OF THE INVENTION

The purpose of the present invention is to save energy in buildings.

This purpose is achieved by means of a roller-blind constructed in.

The basic principle of the invention is that two or more thin sheets of a transparent material are joined to form a closed space so that the room-air can enter through a valve into the space enclosed by the sheets and, when the valve is closed, this gas remains inside and forms an immobile air layer of substantial atmospheric pressure with a heat-insulating capacity.

The effect of the roller-blind consists in that simultaneously as it lets into the room a major portion of the sunlight and thermal radiation, it prevents the heat from going out of the window.

Heat-insulating capacity in a structure is the resistance offered by the latter to the passage of heat.

$$\text{Heat passage number} = k = \frac{1}{\text{heat resistance}} = 1/m = k,$$

which means that the lower the k-value of a structure the better the heat-insulating capacity of the structure.

Thus:

a single window=a window with one window pane has a k-value==7.2 and a double window=a window with two panes+the enclosed air layer has a k-value=2.9.

The k-value for a composite structure of the heat-insulating roller-blind according to the invention, may, by means of established calculation methods, by theoretically calculated according to the following:

| | |
|---|---|
| Surface resistance $m_i + m_u$ = | 0.20 |
| Resistance of the window pane = | 0.01 |
| Resistance of the air space of 2.5 cms = | 0.20 |
| Resistance of the window pane = | 0.01 |
| Resistance of the air space of 12 cms = | 0.21 |
| Resistance of the plastic sheet = | 0.10 |
| Resistance of the air space of 6 cms = | 0.22 |
| Resistance of the plastic sheet = | 0.10 |
| Total heat resistance = m = | 1.05 |
| k = 1/m = 1/1.05 = k-value = 0.95 | |

$m_i$ and $m_u$ in the above table indicate the internal and the external surface resistance, respectively.

The roller-blind according to the invention is suspended from a curtain rod of conventional design above a window in a manner permitting it to be rolled up.

The roller-blind according to the invention is expected to remain pulled down during the day and for this reason it is transparent. The roller-blind is thus suitably manufactured of a glass-clear material of such hardness that the sheets are sufficiently stiff to form flat surfaces in front of the window when the blind is down, so that the view through the window is not distorted. Suitably the sheets consist of a plastic material with good thermal properties, so that they do not melt or catch fire through an accidental contact, for example with an electric heat radiator.

It is usually desirable that as great a portion as possible of the sun's luminous flux should enter through the window. A sheet therefore consists of a material which has the greatest possible transmission, 85 to 90%, in other words, a transparent material.

In certain cases (for example in sunny areas with cold nights) it may be desirable to bar the thermal radiation but to allow the entrance of the luminous radiation. In this case sheets of a plastic material are used which reflect (bar) the infrared light (=the thermal radiation). In such case the blind serves as a heat-insulator during the night.

According to the invention the roller-blind should have a surface which is 10 to 20% larger than the surface of the window which it is to cover.

To obtain special structural properties of the roller-blind according to the invention a special gas may be introduced between the sheets instead of dry air. For example (a) a gas which is lighter than the air, to facilitate the erection of the construction with skylights in the roof, in which case the blind is supported by the air pressure and consequently only needs to be stabilized in the horizontal plane, (b) carbon dioxide, which is capable of extinguishing fire.

When the roller-blind according to the invention is to be rolled up on the curtain rod the air valves are opened, so that the air may be squeezed out when the blind is rolled up. In order that the blind should be able to be rolled up swiftly and conveniently the valve must have a very high evacuation capacity. In an advantageous embodiment of the roller-blind according to the invention the valve is designed as a slit-valve which runs along a considerable length of the blind's lower edge.

As already mentioned the blind according to the invention should be manufactured of a material which is so hard that the sheets have a certain degree of stiffness. When two such congruent sheets are rolled up for example around a curtain rod or shade spool, a certain displacement between the sheets occurs in the direction of rolling. Therefore, the sheets cannot be unresiliently connected to each other at the edges, for example by welding. This problem is solved according to the invention in that a soft and/or elastic edge-band which may absorb the displacement is attached at the edges on all the external sides of the sheets.

In order to achieve a further air layer between the window and the blind, stretching devices may be installed to squeeze the air-filled and thus elastic blind in such a manner that it connects hermetically to the window embrasure and/or to the linings around the window. This framing around the window is termed a "reveal" for the purpose of this application.

When the thickness of an air layer exceeds a certain maximum value air currents may originate within the layer, resulting in decreased heat-insulating capacity of the layer. This decrease is to the same extent as the increase of the thickness of the layer and with that the increase of the air currents. There are windows in which the distance between the panes is so great that this phenomenon takes place. By placing a blind according to the invention in such a space between the panes one obtains three heat-insulating layers with a considerable total heat-insulating capacity. One layer is between the two sheets making up the blind and the other two are between the window panes and the blind.

BRIEF DESCRIPTION OF THE DRAWINGS

An embodiment, chosen as an example, will be described below in detail, with reference to the appended drawings, in which.

DESCRIPTION OF THE PREFERRED EMBODIMENT

Figure 1:
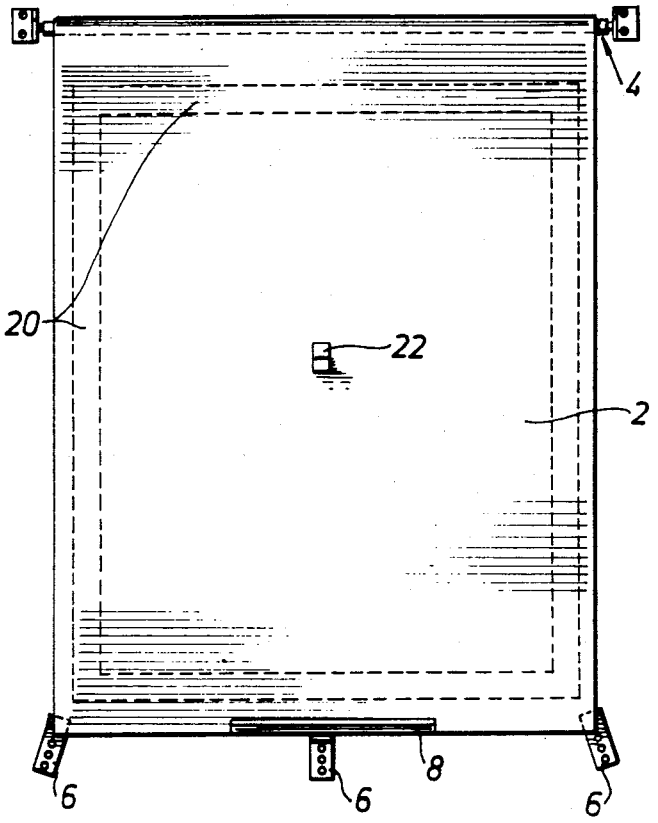
FIG. 1 is an elevational view showing an embodiment of the roller-blind according to the invention pulled down over a window.
Figure 3:
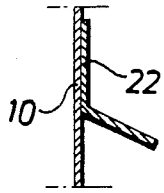
FIG. 3 is a detailed view of the grasping device (catch) for the separation of the sheets of the roller-blind for the filling thereof with air.

FIG. 1 shows a roller-blind 2 pulled down in front of a window. The roller-blind 2 is attached to a roller-blind rod or spool 4 which may be of a conventional kind and attached over the window in the usual way. At the lower edge of the roller-blind a catch designed as a brace 6 is attached to hold the roller-blind under the window. The brace 6 must be attached at the two lateral edges of the roller-blind and at the middle of the blind's bottom edge. At the bottom part of the roller-blind a slit valve is also arranged for filling the blind with air and for emptying it. To give the valve great evacuation capacity it extends along a considerable part of the bottom edge of the blind 2.

Figure 2:
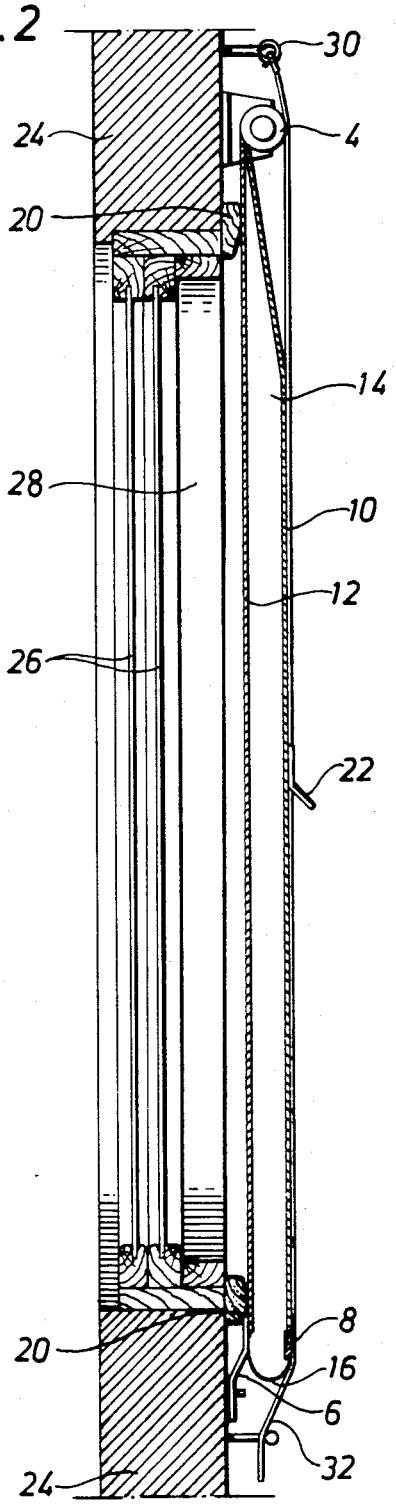
FIG. 2 is a side view of the roller-blind according to FIG. 1 seen in cross-section.

As shown in FIG. 2 the roller-blind 2 consists of two thin sheets 10, 12. The sheets 10, 12 consist of a transparent hermetic material which is flexible but still has a certain stiffness in order to form flat surfaces in front of the window when the blind is down so that the view is not distorted. The sheets suitably consist of a plastic material, such as a polyester film (polyethyleneterephtalate). Suitable thickness of the film is 75 microns.

Figure 4:
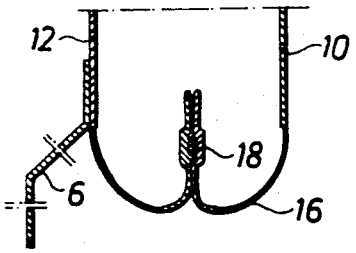
FIG. 4 is a detailed view of the roller-blind in the air-filled condition in lateral view and in cross-section, showing a different valve position.
Figure 5:
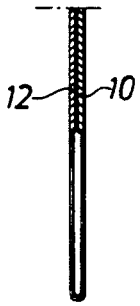
FIG. 5 is a detailed view similar to FIG. 4 with the roller-blind in its deflated condition and without the valve.

The sheets are joined along their outer edges to form an enclosed space 14. The lateral and bottom edges of the sheets 10, 12 are joined by a border band 16 (see also FIGS. 4 and 5). The border bands 16 are soft and elastic so that they may absorb the displacement between the sheets 10, 12 when rolled up over the spool or rod 4. Furthermore, the border bands are wide enough to absorb the expansion between the sheets 10, 12 when air flows in between them, as shown in FIG. 4.

The air valve 8 is suitably designed as a slit in the border band 16 at the lower edge of the roller-blind 2. The slit contains a fast-lock 18 or a device of locking type which is easy to open and close and which in the closed position closes the slit hermetically so that an air-tight enclosed space 14 is obtained between the sheets 10, 12.

At the bottom edge of the roller-blind brace 6 is attached at the external side of the sheet 12 closest to the window panes 26 in order to hold the roller-blind 2 to the wall 24, for example by a hook attached to the wall.

On the sheet 10 facing the room, preferably at its middle portion and directly above the brace 6 a catch 22 is installed, suitably in the form of a flap of the same material as the sheet, in order to ensure in a simple way the separation of the sheets 10, 12 for filling the space with air.

When the roller-blind 2 is rolled up on the curtain rod 4 the sheets 10, 12 lie close to each other and the valve 8 is open. To use the blind, it is pulled down and attached by means of the braces 6. Then the grasping device is grasped and the sheet 10 is pulled away from the attached inner sheet 12, whereby air flows through the opened valve 8 into the space 14 between the sheets. When the required amount of air has entered the valve 8 is closed whereby a non-circulating and thus effective heat-insulating air layer at substantially atmospheric pressure is obtained in the space 14. When rolling up the blind 2 the valve 8 is opened first so that the air may escape during the rolling-up operation. In order to make the blind quick and easy to use it has proved necessary in practice to have a valve which in its open position has a large opening for the inflow and outflow of air when the sheet 10 is pulled away from the sheet 12 and when the blind is rolled up, respectively. The slit therefore extends along a considerable portion (about ⅓ as shown in FIG. 1 of the bottom edge of the blind.

The suitable roller-blind 2 may be attached to the curtain rod by attaching the upper edge of the sheets 10, 12 with double-adhesive tape on the rod of the roller-blind. As seen in FIG. 1 the roller-blind 2 is somewhat wider than the window, preferably 10–20% wider.

The air-filled blind 2 is normallly so elastic that it adjoins, with good air-tightness, with the contact surfaces or reveal 20 around the window when it is attached by the brace 6. In this manner, a further non-circulating, heat-insulating air layer 28 is obtained between the blind and the window pane 26. Braces 6 thus act as stretching means to secure at least one of the sheets, that is sheet 12, against the window reveal 20.

If the embrasure of the window or its linings do not have smooth, straight surfaces the blind 2 can still be brought to good contact by using a holder 30 above the blind, for example in the form of a hook, and stretch a band or a string over the blind to a holder 32 below the blind. In this manner the air-filled blind is pressed by means of its elasticity until good contact is achieved even aginst uneven contact surfaces.

A drying agent is suitably placed between the sheets in the blind in order to prevent a build-up of condensation.

Furthermore, the sheets are suitably treated to be antistatic so that no air-suspended particles cling to the sheets.

In order to enable the installation of a roller-blind according to the invention also on the outside of a window, the sheets should suitably be made of a material which is resistant to ultraviolet radiation.

In an alternative embodiment the braces at the lateral edges of the blind may be replaced by a tightening device attached to the wall.

I claim:

1. A heat-insulating roller-blind adapted for placement in front of a window of a room, comprising:

two thin, transparent, hermetic, congruent sheets having side outer edges, a top and a bottom outer edge, said sheets formed of stiff but flexible material which tends to remain flat when said sheets are unrolled;

a spool connected to said upper outer edges of said two sheets for rolling said two sheets up;

a soft, elastic border band connected between said two sheets at said side outer and bottom edges thereof for defining a single contiguous closed space with said sheets when said sheets are unrolled from said spool and hang below said spool, said elastic border band being sufficiently wide to absorb any relative displacement between said two sheets when said two sheets are rolled upon on said spool, and sufficiently wide to absorb an expansion between said sheets to form said space so that said sheets remain flat when air is admitted into said space defined by said sheets and said border band;

a valve connected to close and open said space and located adjacent said lower outer edges of said two sheets, said valve having an open position for admitting room air to said space and for discharging air from said space when said two sheets are rolled on said spool; and manual engagement means connected to one of said two sheets for separating said two sheets to form said space when said two sheets are unrolled from said spool and hang below said spool and said valve is in its open position, said valve having a closed position for retaining air in said space for obtaining a non-circulating, heat-insulating layer of air at substantially atmospheric pressure between said sheets.

2. A blind according to claim 1, wherein said manual engagement means comprises a catch connected to one of said sheets near a center thereof.

3. A blind according to claim 2, wherein said catch comprises a tab made of the same material as said two sheets connected to said one of said two sheets.

4. A blind according to claim 1, wherein said valve comprises a slit valve, said slit valve having the length extending over a substantial part of a width of said blind.

5. A blind according to claim 4, wherein said slit valve extends over about one-third of a width of said blind.

6. A blind according to claim 5, wherein said slit valve includes fast-lock means for readily moving said valve into its open and closed position.

7. A blind according to claim 1, wherein said two sheets are made of plastic material that is sufficiently heat-resistant so as not to melt when in contact with an electric radiator.

8. A blind according to claim 1, including stretching means for securing at least one of said two sheets into close proximity with a window reveal of a window to be covered by said blind so as to form a non-circulating, heat-insulating air layer between a window to be covered by said blind and said blind.

9. A blind according to claim 8, wherein said stretching means comprises a plurality of brackets connected to one of said sheets adapted to be adjacent a window to be covered and hook means for engaging said brackets.

10. A blind according to claim 8, wherein said stretching means comprises at least one elongated elastic member connectable to a frame surrounding a window to be covered by said blind and engaged over and lying against one of said sheets adapted to be positioned away from a window to be covered by said blind.

11. A blind according to claim 1, including a drying agent placed between said sheets in order to absorb any condensation build-up in said space.

12. A blind according to claim 1, wherein said sheets are anti-statically treated.

13. A blind according to claim 1, wherein said sheets are made of material which is resistant to ultraviolet radiation.

14. A blind according to claim 1, wherein said sheets are formed of a material which transmits any central part of visible light and reflects infrared heat-radiation to act as a heat insulator.

15. A heat-insulating roller-blind intended to be placed in front of windows, comprising two thin, transparent, hermetic, congruent sheets defining a space, and a valve located at a bottom of the blind for admission to said space of air and outflow of air when the blind is rolled up to reduce said space, characterized in that the sheets consist of a stiff, but flexible material, and in that the sheets in their outer edges are hermetically joined to from a single, continuous enclosed space, said outer edges being joined by border bands which are soft and elastic and are capable of absorbing a relative displacement of the sheets when the blind is rolled up on a curtain rod, said border bands having such a width that they can absorb the expansion between the sheets when air is admitted into said space, said valve being openable and closeable to enable, in its open position, admission to said space of the air when manually separating the sheets, thus obtaining a non-circulating, heat-insulating layer of air between the sheets upon closure of the valve.

16. Heat-insulating blind according to claim 15, characterized in that the valve is designed as a slit valve, which valve, when the blind is to be rolled up, can be opened about $\frac{1}{3}$ of the width of the blind.

17. Heat-insulating blind according to claim 15, characterized in that the sheets consist of a plastic material which does not melt at a contact with an electric radiator.

18. Heat-insulating blind according to claim 15, characterized by stretching devices for securing for air-tight connection between air-filled blind and a window reveal, so that a basically non-circulating, heat-insulating gas layer is obtained between a window and the rolling-blind.

19. Heat-insulating blind according to claim 15, characterized in that a drying agent is placed between the sheets in order to counteract the building-up of condensation.

20. Heat-insulating blind according to claim 15, characterized in that the sheets are anti-statically treated.

21. Heat-insulating blind according to claim 16, characterized in that said slit valve comprises a fast-lock for easy opening and closing of the valve.

22. Heat-insulating blind according to claim 15, characterized in that said sheets consist of a material which is resistant to ultraviolet radiation.

23. Heat-insulating blind according to claim 15, characterized in that the sheets are formed of a material which transmits an essential part of visible light and reflects infrared heat radiation to form a heat insulator.

* * * * *